US011560681B1

(12) United States Patent
Dancer

(10) Patent No.: US 11,560,681 B1
(45) Date of Patent: Jan. 24, 2023

(54) SELF-EXPANDING BARRIER HAVING A MESH SHEATH

(71) Applicant: Carol Dancer, Attleboro, MA (US)

(72) Inventor: Carol Dancer, Attleboro, MA (US)

( * ) Notice: Subject to any disclaimer, the term of this patent is extended or adjusted under 35 U.S.C. 154(b) by 0 days.

(21) Appl. No.: 17/082,290

(22) Filed: Oct. 28, 2020

Related U.S. Application Data

(60) Provisional application No. 62/927,660, filed on Oct. 29, 2019.

(51) Int. Cl.
*E02B 3/12* (2006.01)
*E02B 3/10* (2006.01)

(52) U.S. Cl.
CPC ..... *E02B 3/108* (2013.01); *E02B 3/126* (2013.01); *E02B 3/127* (2013.01)

(58) Field of Classification Search
CPC ..... E02B 3/108; E02B 3/126; E02B 3/127
See application file for complete search history.

(56) References Cited

U.S. PATENT DOCUMENTS 5,125,767 A 6/1992 Dooleage
6,527,477 B1 * 3/2003 Allard ..... B32B 1/08 405/302.6
6,641,335 B1 * 11/2003 Allard ..... B32B 1/08 405/15
6,783,300 B2 * 8/2004 Doolaege ..... E02B 3/108 405/115
6,905,289 B1 * 6/2005 Sanguinetti ..... E03F 5/0404 405/21
7,762,742 B1 * 7/2010 Smith ..... E02B 3/108 405/114
7,811,028 B1 10/2010 de la Rosa
8,088,779 B2 1/2012 McInnis et al.
9,297,134 B1 3/2016 Dancer
10,335,724 B1 * 7/2019 Morris ..... B01D 29/03
2002/0172557 A1 * 11/2002 Chen ..... E02B 11/005 405/43
2004/0057797 A1 * 3/2004 Ring ..... E02B 11/005 405/46
2007/0125568 A1 * 6/2007 Kida ..... E02B 3/127 174/77 R
2008/0202073 A1 8/2008 Kim
(Continued)

FOREIGN PATENT DOCUMENTS

JP 03286010 12/1991
WO WO2011/061539 5/2011

OTHER PUBLICATIONS

Apex Mills; "PG12"; Jun. 27, 2017 (Year: 2017).*

*Primary Examiner* — Benjamin F Fiorello
(74) *Attorney, Agent, or Firm* — C Nessler

(57) ABSTRACT

An article for use in damming or channeling surface water flow is comprised of a non-woven polymer fabric sleeve which is encased in a sheath made of polymeric mesh. The sleeve contains a water absorbent material. When water passes through the sheath and sleeve, the absorbent swells up, to change the barrier from a flattened article to a bulky shape article. Preferably, the sleeve is black or brown and the sheath is a mesh comprised of highly visible bright orange fibers; the sheath has a regular pattern of openings nominally equivalent in area to 4 to 5 mm diameter holes; and the sheath has about 25 to about 60 percent open area.

13 Claims, 5 Drawing Sheets

(56) References Cited

U.S. PATENT DOCUMENTS

| | | | | |
|---|---|---|---|---|
| 2009/0208288 | A1* | 8/2009 | Stephens | E02B 3/127 405/45 |
| 2010/0232882 | A1* | 9/2010 | Tasker | E02B 3/127 405/107 |
| 2011/0123271 | A1 | 5/2011 | Walthall | |
| 2011/0165294 | A1 | 7/2011 | Versteylen et al. | |
| 2011/0280660 | A1 | 11/2011 | Bahukudumbi et al. | |
| 2011/0297575 | A1 | 12/2011 | Bouchard et al. | |
| 2011/0311312 | A1 | 12/2011 | Bouchard et al. | |
| 2012/0003049 | A1 | 1/2012 | Sprague et al. | |
| 2014/0226918 | A1* | 8/2014 | Adams | E02B 3/108 383/1 |

* cited by examiner

SELF-EXPANDING BARRIER HAVING A MESH SHEATH

This application claims benefit of provisional patent application Ser. No. 62/927,660, filed Oct. 29, 2019

TECHNICAL FIELD

The present invention relates to devices for controlling flow of surface waters, in particular for blocking the flow of flood waters.

BACKGROUND

For controlling the flow of surface waters in the same way as sand bags are used, barriers may be provided by putting within a water-permeable non-woven polymer fabric sleeve a water absorbent material that, upon contact with sufficient water, swells up to 20 or more times its initial size. When such a barrier is manufactured, the water absorbent material is put within the flat-tubular fabric sleeve as a powder or sheet. See U.S. Pat. No. 9,297,134 "Self-Expanding Barrier for Control of Surface Water Flow," which is commonly owned with this present application. Preferred barriers have a D-shape front lobe and a rear lobe that inhibits overturning of the barrier during use.

Prior to use, the absorbent contained within the sleeve of a barrier is dry. Thus, only a small interior volume is needed to contain the absorbent and any associated carrier sheet or pouch, etc. That enables the barrier to be stored and shipped in a compact flat or folded condition. To put a barrier in condition for use, the absorbent must be contacted with water sufficient to cause it to expand substantially. This may be done in any manner, including in one or more exemplary modes: (a) the user sprays water on the barrier or wets it by submersion at the time of placement; (b) the user drops a barrier in a puddle or other mass of water; (c) rain wets the barrier after placement; and (d) surface water approaches and infiltrates an in-place barrier.

Prior to use, an invention barrier is substantially flat and light in weight; it has a small cross section area interior cavity within which is contained water-absorbent substance. For a two lobe barrier, the water absorbent material is preferably in the form of a cellulose sheet that is captured by lengthwise stitching that separates the front lobe and rear lobe.

A preferred fabric for embodiments of the invention is a non-woven plastic polymer material, in particular a commercial material comprising needle-punched nonwoven polypropylene textile. See the Description below for more detail about the fabric. The barrier needs to have a fineness of openings such that the gelatinous mass of swelled up absorbent is retained within the barrier during use.

While different color fabrics can be used, as described in the '134 patent, different colors of the same kind of fabric impart differing durability to a barrier, with respect to sunlight/ultraviolent degradation of the swelled-up water absorbent material, in particular SAP, during use. Black and brown colors are preferred. But such dark color barriers may be poorly visible in darkened areas where barriers are used.

During use, an expanded barrier may be dragged about or otherwise handled, which can result in cutting or tearing damage to the barrier fabric and failure of the barrier. The necessity of having a water permeable low-cost material that retains the gelatinous mass limits fabric choice.

SUMMARY

An object of the invention is to provide a barrier containing a water absorbent/swelling substance, which barrier has improved resistance to damage without comprising the ability to compactly store the barrier when dry prior to use, or the ability to dry the barrier after use. Another object is to provide a barrier which is highly visible for safety reasons.

The invention is referred to as an encased barrier. An embodiment of the invention comprises a sleeve made of porous fabric material, such as 0.3 mm thick water-permeable nonwoven geotextile, which is encased within a sheath made of mesh material. Contained within the sleeve prior to use is a substance that absorbs water upon contact, preferably a super-absorbent polymer (SAP) in powder or sheet form. The sheath is sufficiently flexible to permit the water absorbent substance to expand in volume, enabling the encased barrier to change from a typically flat object (suitable for easy shipping or storage) to a bulky three dimensional object suited for impeding the flow of surface waters. The sleeve is preferably fully enclosed or encompassed within the sheath, but embodiments may include a sheath that only partially encases a sleeve.

The sheath can protect the sleeve when the encased barrier of the invention is dragged across a rough surface, such as a driveway. The fabric of the sleeve is preferably made of black or brown sunlight-resisting polypropylene, and the fabric of the sheath preferably has an orange or other attention-catching color. In comparison, it would be a disadvantage to use a sleeve having a bright or light color because experiments show (as described in U.S. Pat. No. 9,297,134) that such kind of material has inferior durability.

The sleeve fabric has small openings, sufficient to contain the gelatinous expanded water absorbent polymer. In comparison, the sheath material has openings that are too large to contain the gelatinous polymer. In embodiments of the invention, the sheath comprises a polyester mesh and the fraction open area of the sheath is-will range from about 25 percent to about 60 percent; more preferably between about 36 percent and about 48 percent open area. When the sheath open area is greater than the upper limit, there is a tendency for the sleeve to be inadequately protected from abrasion, etc., and for the encased barrier to be less visible to a viewer. When the sheath open area is less than the lower limit, the flow of water or water vapor through the sheath can be impeded, in particular, increasing the time for a used barrier to be dried.

An exemplary invention sheath is made of woven polyester material and is about 0.5 mm thick. And it has a plurality of same-size holes arranged on a regular pattern, such as oval openings arranged rectilinear pattern with successive lines in staggered offset. And each hole has an area that is approximately equivalent to a round hole having a diameter of about 4 to 5 mm.

The foregoing and other objects, features and advantages of the present invention will become more apparent from the following description of preferred embodiments and accompanying drawings.

BRIEF DESCRIPTION OF THE DRAWINGS

FIG. 9 is inverted, compared to the sectioning indicated in FIG. 8.

DESCRIPTION

The present invention comprises a gelatinous mass that is contained within a tubular sleeve made of water permeable fabric having fine openings. The sleeve (which may be very much like one of the barriers described in the '134 patent) is contained within a sheath (or "case") that has openings for passage of water. Thus, an article of the present invention, is referred to as an encased barrier. Embodiments of the present invention comprise an interior portion that is functionally in accord with barriers described in U.S. Pat. No. 9,297,134 "Self-Expanding Barrier for Control of Surface Water Flow", issued Mar. 29, 2016 (the '134 patent" hereafter), the disclosure of which is hereby incorporated by reference. Just below, a barrier without a sheath is described first. Then, encased barrier embodiments in accord with the present invention are described.

Figure 1:
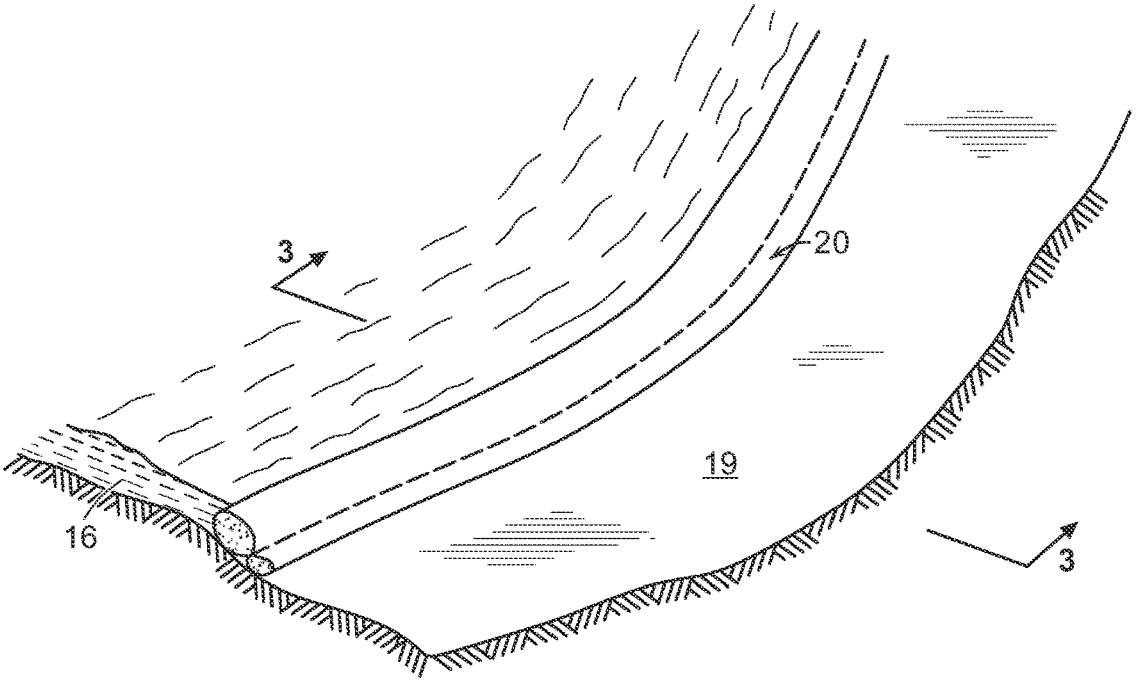
FIG. 1 is a perspective view of a two lobe barrier being used to dam surface water.
Figure 2:
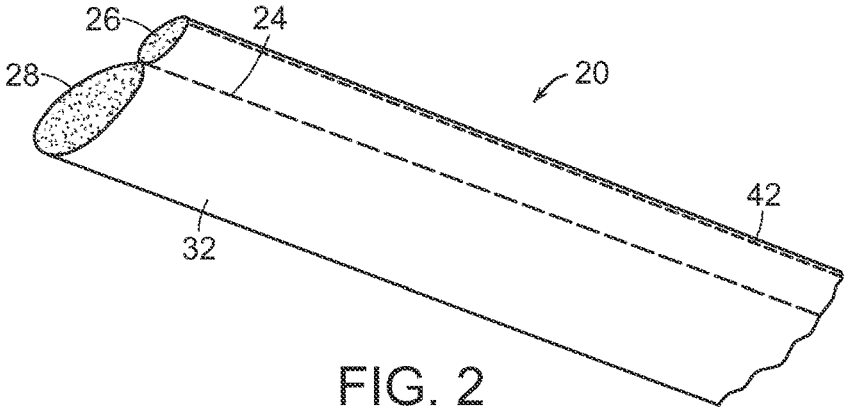
FIG. 2 is a perspective view showing the underside of part of the two lobe barrier of FIG. 1.
Figure 3:
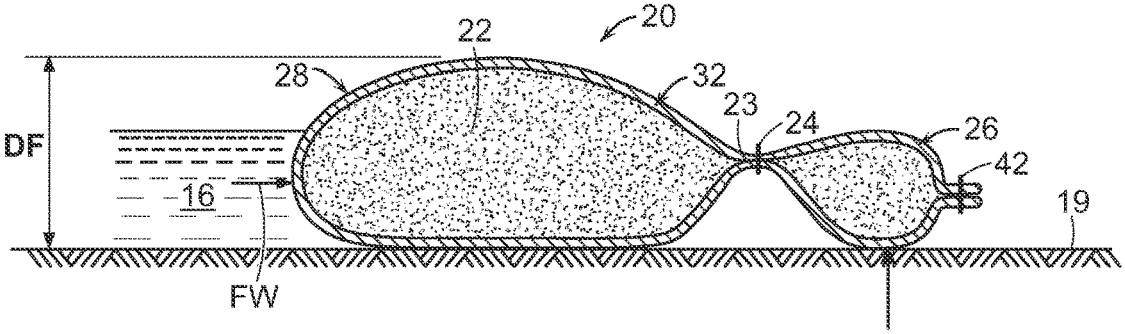
FIG. 3 is an end elevation view cross section of a two lobe barrier of FIG. 1.
Figure 4:
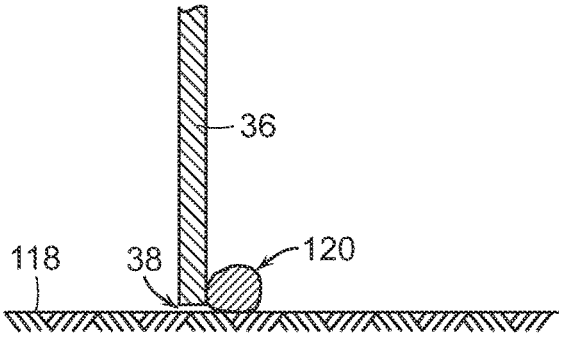
FIG. 4 is a side elevation cross section view of a single lobe barrier resting against the bottom of a door to a structure.

An exemplary barrier 20 of the two-lobe type is shown in use in the perspective view of FIG. 1. The barrier is lying on a surface 19 of earth, to contain, or dam, water 16 which would otherwise spread further over the surface. FIG. 2 shows a portion of barrier 20 in perspective, looking upwardly at the underside of the barrier, as if the barrier were suspended in space. FIG. 3 is a cross section through the in-use barrier of FIG. 1, showing how it holds back water 16. Exemplary barrier 20 comprises a fabric sleeve 32 which is a rectangular sheet that is folded upon itself and stitched along seam 42 at the rear edge of the barrier. Barrier 20 is divided lengthwise by stitching seam 24 into a front portion 28 and a rear portion 26, which front and rear portions are mostly referred to here as lobes. FIG. 4 shows a single lobe barrier 120 blocking the space 38 between a door 36 and the floor surface 118; the single lobe barrier is discussed further below.

Figure 5:
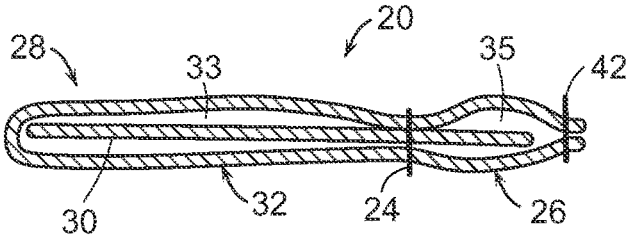
FIG. 5 is a cross section view of a two-lobe barrier in dry flattened condition where the rectangular sheet of material that forms the barrier is attached to itself at the rear edge of the barrier.

FIG. 5 shows in cross section barrier 20 in dry condition (prior to use). A water absorbent sheet 30 containing super-absorbent polymer (SAP) is captured by lengthwise stitching 24 that defines the interior concavities 33, 35. The water absorbent sheet disintegrates into a gelatinous mass with sufficient water contact. The vertical dimensions in this and like other Figures that show flattened barriers are exaggerated for better illustration of details. In the most compact flattened dry condition, each exemplary barrier interior concavity will have a very small cross sectional area and associated volume, preferably about equal to, or a little larger than, the area/volume of the absorbent contained therein.

Figure 5A:
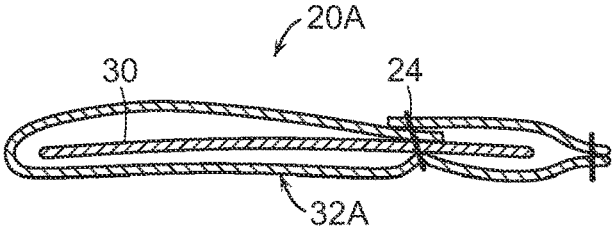
FIG. 5A is a view like that of FIG. 5, showing a sheet that is fastened to itself at the lengthwise seam which creates the two lobes.

FIG. 5A shows alternative configuration barrier 20A, where the fabric sleeve 32A is a rectangular sheet that folds upon itself, and the sheet is secured to itself by the stitching seam 24 that defines the front and rear lobes and that also captures the water absorbent sheet. The lengthwise ends of a barrier are closed, as by stitching or other fastening that runs transverse to the barrier length; such closing is sufficient to prevent escape of the absorbent before wetting (e.g., if it is a powder) and to contain the gelatinous mass after wetting. In embodiments not pictured, there may be stitching that runs transverse to the length at locations inboard of the ends, so along its length a barrier is divided into a series of separate sections.

Figure 6:
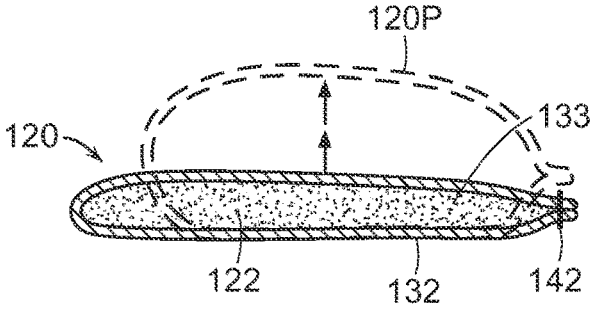
FIG. 6 is a cross section view of a single lobe barrier in dry flattened condition, showing in phantom how the barrier swells to an oblong cross section shape when it is in use.

The present invention may also comprise barriers having other shapes and other internal configurations, and may contain other types and forms of absorbent material. Barriers may also have other uses than those described here. FIG. 6 shows a single lobe barrier 120, prior to use, and during use by means of a phantom and associated shape-change arrows. The fabric 132 of barrier 120 defines a concavity 133 that contains super-absorbent polymer (SAP) in the form of powder 122. The sleeve fabric 132 has been folded on itself and fastened to itself by fastener 142 at the rear edge of the barrier. Phantom outline 120P suggests how the barrier is shaped when the absorbent powder is wetted and expanded.

The absorbent used within a barrier of the present invention may comprise other known or future substitutes which are equivalents to those absorbent materials that are described here and in Patent '134 and elsewhere in the art. The absorbent for the barrier may be a so-called super absorbing polymer (SAP), which is generally a hydrogel. SAP is familiar in commerce, for instance in the fabrication of diapers for babies, feminine care pads, meat pads, and other commercial water absorbing devices. A familiar SAP is comprised of polymerized acrylic acid in combination with sodium hydroxide, with an initiator, forming sodium polyacrylate when wetted. The resultant mass is gelatinous. As known in the technical literature, other materials may be used for SAP, including polyacrylamide copolymer, ethylene maleic anhydride copolymer, cross-linked carboxymethylcellulose, polyvinyl alcohol copolymers, cross-linked polyethylene oxide, and starch grafted copolymer of polyacrylonitrile. See also the teachings of Watanabe et al. U.S. Pat. No. 7,258,904, the disclosure of which is hereby incorporated by reference.

While thread-stitching is mostly referred to with respect to forming barriers, alternative means may be used in making barriers. For example, riveting, stapling, adhesives, ultrasonic welding, and thermal fusion welding, may be used instead of or in combination with, stitching, and in combination with each other.

A fabric used in embodiments of the sleeve of the present invention is a non-woven plastic polymer material. In particular, a commercial material comprising needle-punched nonwoven polypropylene textile weighing about 92 grams per square meter (2.7 ounces per square yard) and having a thickness of about 0.3 mm (0.012 inches). Other non-woven fabrics such as Dupont™ spunbonded polypropylene fabric may be used. Commercial fabrics which are often buried in soil for drainage and filtration purposes, familiarly called geotextiles, may be used. Useful geotextiles have permittivity as measured by ASTM 4491 standard in the range 1-2 seconds$^{-1}$.

Other kinds of commercial porous fabrics made from polyolefins other than polypropylene may be used, provided the fabric has sufficient porosity to enable water to infiltrate the interior of the barrier in easy fashion. At the same time, the effective sizing of the pores of a useful fabric will be small enough to prevent significant escape of the gelatinous mass of the swelled up SAP under normal use. The preferred non-woven fabrics do not elongate substantially, if and when the SAP expands sufficient to strain the fabric. Elongation of a fabric could be about 4 percent or less.

In embodiments of the present invention a barrier like one of those just described—or having alternative other configurations—is encased within a tough water permeable sheath. Thus, it is referred to as an encased barrier (or simply a barrier), and the inner fabric structure is called the sleeve. Preferably, the sheath has an attention getting color, such as OSHA safety orange, which color contrasts with a dark color of nonwoven fabric that is preferentially used, in accord with the teachings of the '134 patent.

Figure 7:
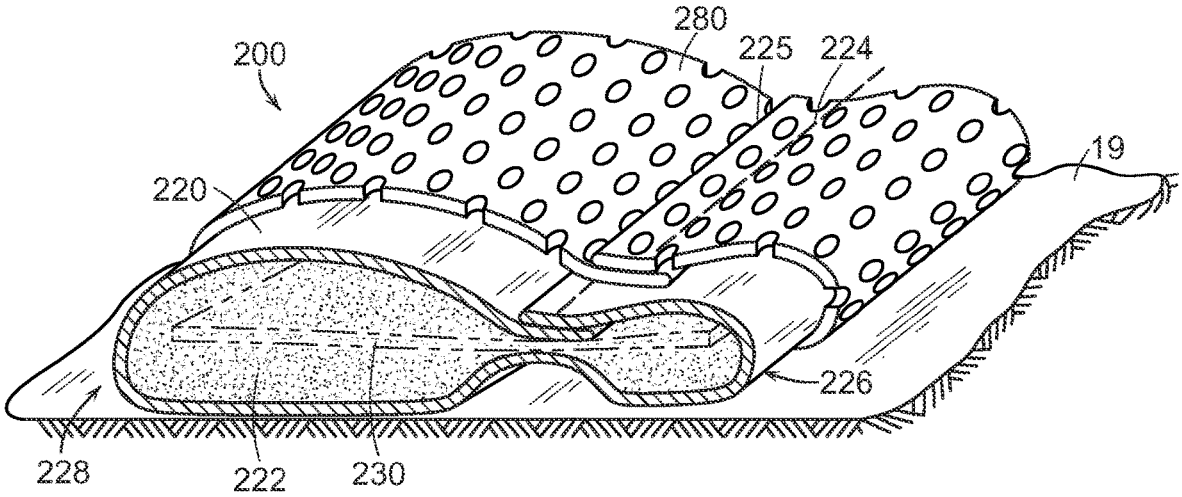
FIG. 7 is a perspective view of an encased barrier, namely, a two-lobe sleeve having a sheath. The barrier is swelled up and ready for use. The end of the barrier is cut away to show the internal construction.
Figure 8:
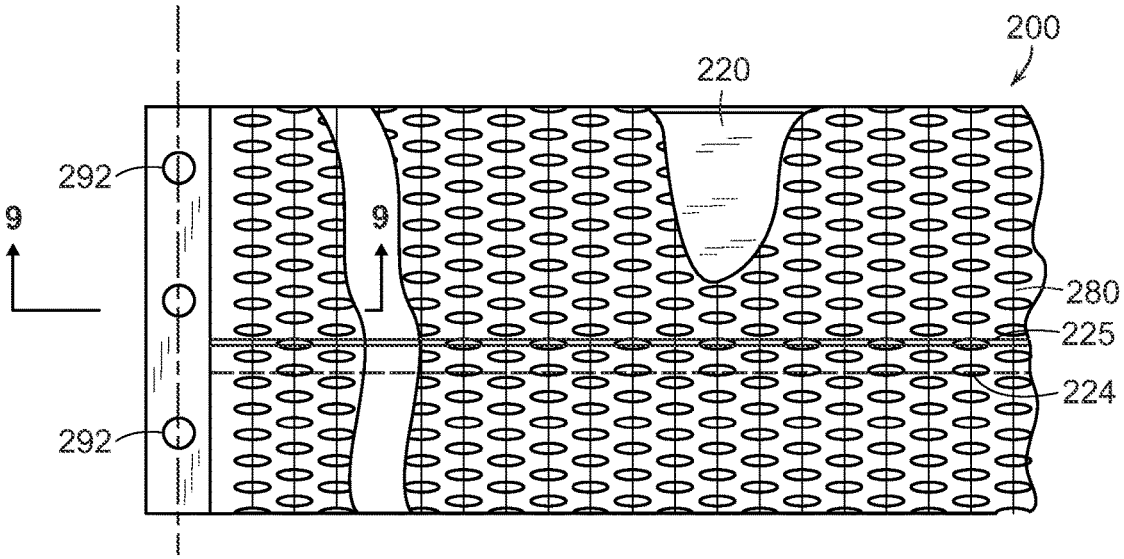
FIG. 8 is a top view of the FIG. 7 encased barrier.
Figure 9:
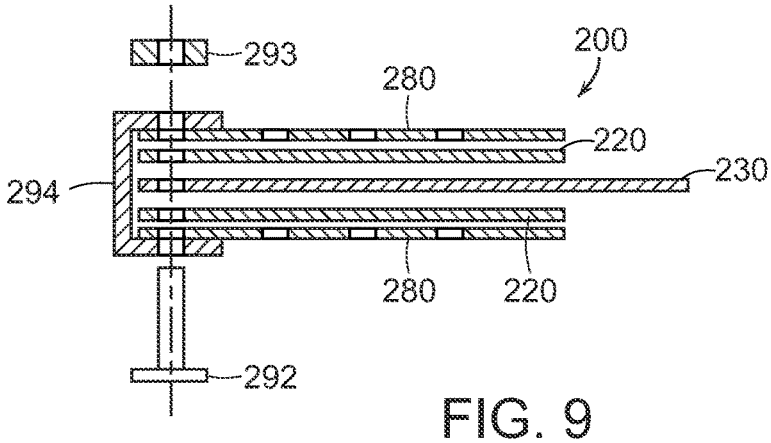
FIG. 9 is an exploded partial vertical cross section through the end of the barrier shown in FIG. 7 and FIG. 8.

FIG. 7 is a perspective, partial cut away, view of encased barrier 200 comprising sleeve 220 that is formed of nonwoven fabric and contains SAP or other water absorbent material 222. The barrier is shown in its swelled up or use condition. FIG. 8 is a top view of the encased barrier 200 with a portion of the sheath cutaway. FIG. 9 is an exploded partial cross section through the end of the encased barrier 200, showing how an exemplary barrier end is closed.

The encased barrier 200 is shown in its dry as-manufactured condition in FIG. 9. Thus, FIG. 9 shows a sheet 230 containing SAP, whereas both FIG. 7 shows a gelatinous mass 222. The phantom of sheet 230 is portrayed in FIG. 7. The sleeve and the sheath of barrier 200 are exemplarily each made by folding a rectangular sheet upon itself and securing the sheet to itself by stitching 224 that separates the front lobe 228 and rear lobe 226. Thus, edge 225 of the sheath sheet is visible in FIG. 7 and FIG. 8. Alternatively, the sheets of the sleeve and/or sheath may be attached to each other at the rear edge or front edge or both (when multiple pieces are used).

Consistent with the description above relating to barriers that do not have sheaths, prior to contact with water, an encased barrier will be a substantially flattened tubular structure. In the generality of the invention, an encased barrier may comprise a barrier having one, two, or more lobes. Barriers of the present invention may have other shapes and forms, as are referred to herein, known in the art, or as may exist in the future.

A barrier like that of the FIG. 7 and FIG. 9 embodiments has a length, opposing lengthwise ends, a width and opposing front end and a rear end. As described, the sleeve has a plurality of openings for passage of water which are sufficiently small enough to inhibit any substantial passage of gelatinous water absorbent material. In comparison, the sheath has a plurality of openings for passage of water to and from the sleeve surface; and the opening size is greater than is sufficient to substantially contain said gelatinous mass.

The partial cross section through the end of barrier 200 at FIG. 9 shows how a typical end of a barrier may be closed. The closing may be by means of stitching, as previously described. FIG. 9 shows how rivet fasteners 292 may be used instead. (There might be also stitching in addition.) During assembly, the shank or plain end of the rivet is flared to draw washer 293 toward the head of the rivet, compressing the sheets together. A piece 294 of nonwoven fabric has been wrapped around the squeezed-together flattened end of the sheath prior to the fastening step, to enhance closure of the end. Adhesives or ultrasonic (thermal) welding may be used in place of, or in addition to, stitching or mechanical fasteners. When an encased barrier is made as just described there will be desirable minimal relative movement of the sleeve within the sheath. Nonetheless, alternatively, a sleeve may be first formed as described in connection with FIGS. 3, 5, 5A and 6, and then placed within a sheath, the material of which sheath is independently secured to itself and not to the sleeve.

As described in more detail below, an exemplary sheath is a mesh material that has openings sufficiently large so that, compared to a same-size sleeve having no encasement, there is a lack of substantial adverse effect on capacity of water to contact the sleeve particularly if the water should be applied by spraying rather than flooding. The sheath used for an encased barrier comprises a mesh material which is flexible and thin, so that when a barrier that is arranged for use, as shown for example in or FIG. 1, 2, 4, or 7, the encased barrier does not significantly impede the water-retarding contact of the underside of the barrier with the surface 19 on which it rests. While the exemplary embodiments show a sheath that covers the entire exterior of a sleeve, an embodiment of the invention may comprise a sheath that covers less than the entirety of the sleeve exterior. For example, in FIG. 7, such a sheath would only be on the upper surface or only on the lower surface; and the fore and aft sheath edges may be attached to the sleeve by stitching or other fasteners along the length of the front end and the length of the rear edge. In such articles the barrier may still be referred to as an encased barrier, albeit the encasement is partial.

Figure 10:
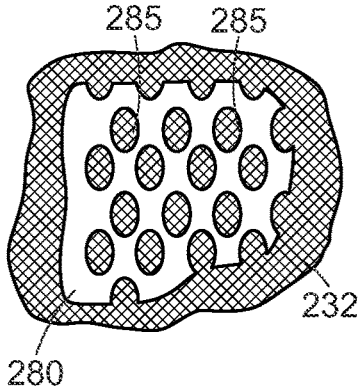
FIG. 10 is a close up cutaway view of a portion of the external surface of the FIG. 7 encased barrier.

FIG. 10 is a close up, or bird's eye view, of the external surface of the barrier 200. It shows a fragment of the sheath 280, cutaway, as it overlies the nonwoven fabric 232 of the sleeve 220 which contains the absorbent material. An exemplary sheath is a mesh sheet, being comprised of a multiplicity of openings 285.

An exemplary sheath of the present invention will provide a tough and visible surface while at the same time allowing easy flow of water from the exterior of the barrier into and through the nonwoven fabric sleeve. A sheath useful in the invention is comprised of woven polyester material of the kind provided as product PG12 mesh by Apex Mills of Inwood, N.Y., having a weight of 3.6 ounces per square yard and an approximate thickness of 0.5 mm (0.020 inch). Meshes of the present invention may weigh more or less than the PG12 mesh on a unit area basis, and meshes may be formed of other materials than polyester, including such as polyolefins. Other meshes may comprise flexible film/sheet that has punched holes.

Figure 11:
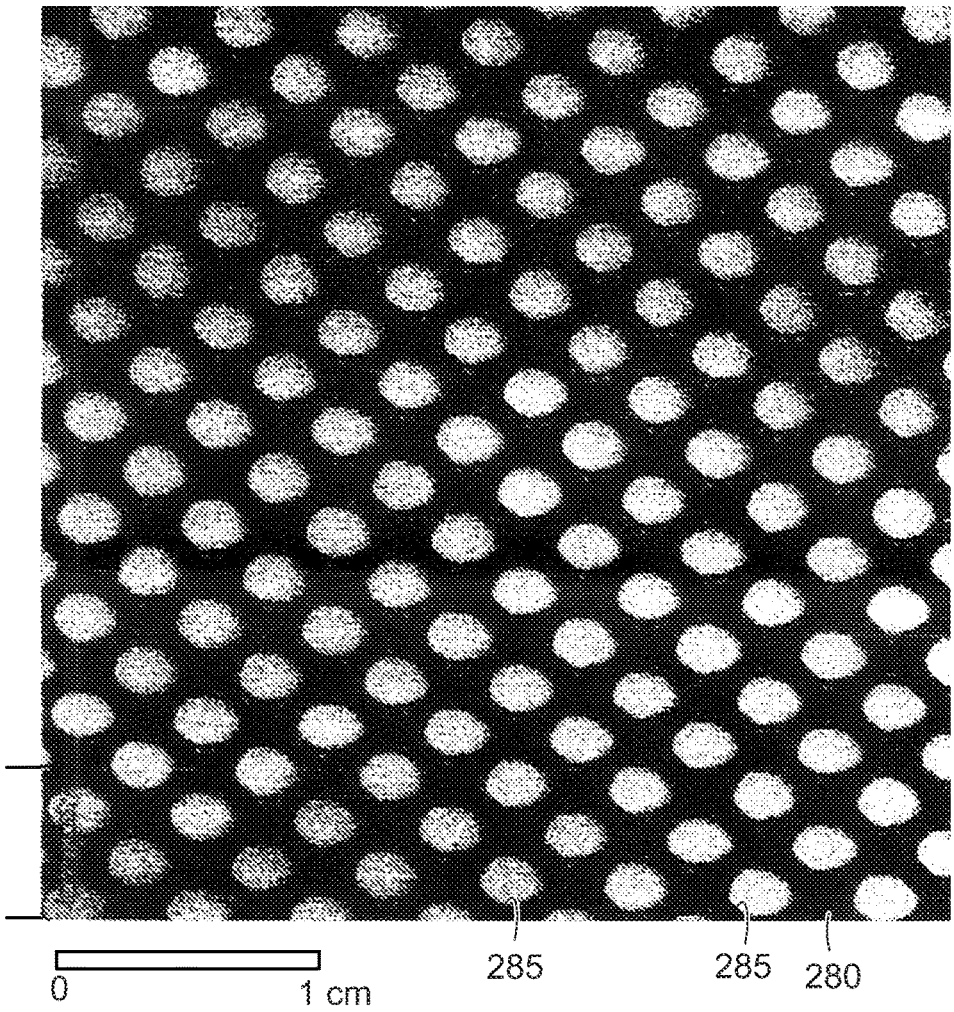
FIG. 11 is a planar view of a portion of an exemplary mesh sheath.
Figure 12:
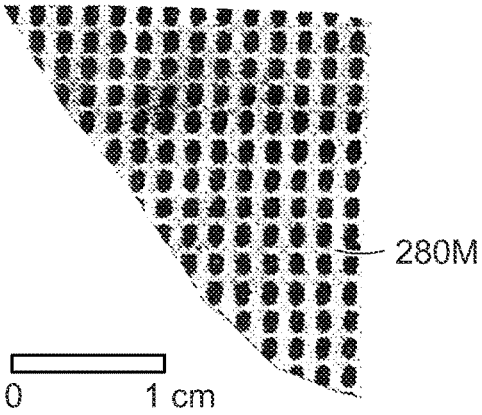
FIG. 12, FIG. 13, FIG. 14, FIG. 15, and FIG. 16 each show a portion of a mesh sheath material, to illustrate exemplary openings of the material and pattern of arrangement of the openings.

The pattern for the PG12 mesh is shown in planar view in FIG. 11. The openings 285 of the exemplary PG12 mesh material are oblong and have approximately a width of about 0.16 inch (4 mm) and length of about 0.22 inch (5.6 mm). So, if such an opening is characterized in terms of approximate equivalence in area to a round hole, the diameter of the round hole would be about 0.187 inch (4.6 mm). Thus, a preferred invention sheath has a plurality of holes, each of which has an area equivalent to a round hole having a diameter of about 4 to 5 mm. As discussed in more detail below, the open area of a preferred mesh sheath of the kind shown in FIG. 11 is somewhat less than about 50 percent. In embodiments, a sheath material in mesh form has a capacity to flow water that is compatible to the fabric of the sleeve; that is the sheath flow capacity is at least about equal to or is greater than the flow capacity of the sleeve.

Figure 13:
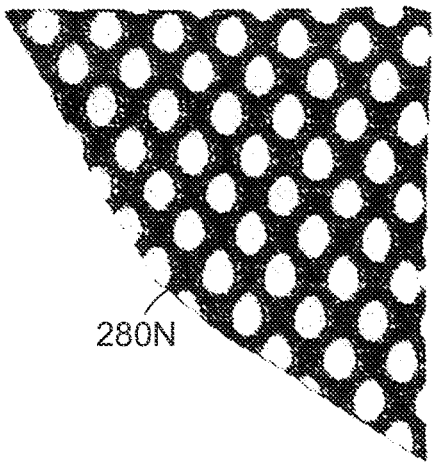
Figure 14:
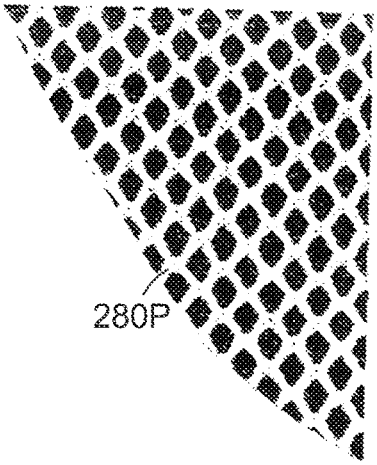
Figure 15:
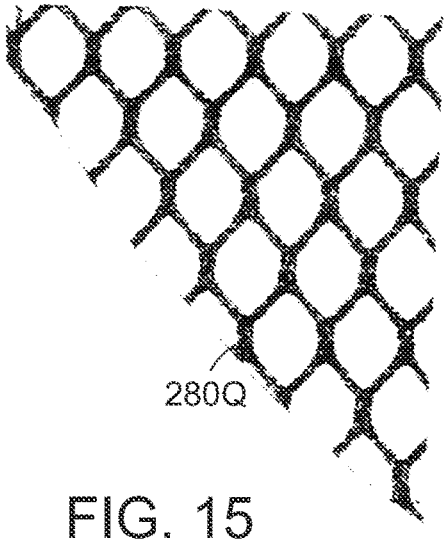
Figure 16:
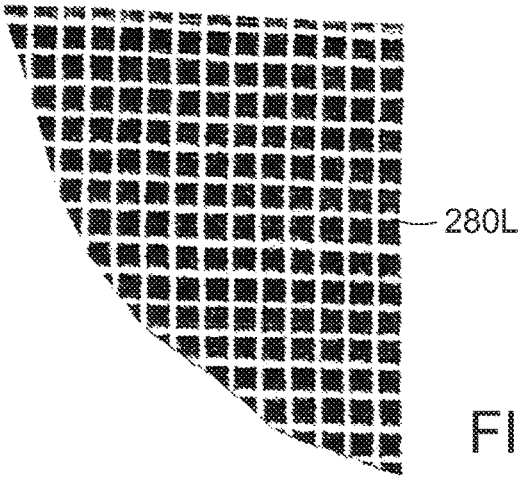

The openings of mesh 280 in FIG. 11 may be characterized as being arranged in a rectilinear pattern with successive lines in staggered offset. Other configurations of material may be used as sheath. The following planar views illustrate some of them. FIGS. 12 through 16 are all of the same scale, which scale is somewhat smaller that the scale of FIG. 11. Mesh 280M of FIG. 12 has oblong holes that are on a regular orthogonal pattern without alternating line offset. Mesh 280N of FIG. 13 shows another staggered offset oblong hole pattern like FIG. 11. FIG. 14 and FIG. 15 respectively show mesh 280P and mesh 280Q, both of which have a staggered offset diamond shape hole pattern. Mesh 280L of FIG. 16 has an orthogonally arranged pattern of rectangular (square) openings, without alternating line offset.

A mesh of the present invention desirably comprises a material which is flexible and bendable so the product can be packaged as a flattened tubular structure, and/or folded along its length, without suffering a crease or set that later impedes the effectiveness of a barrier when a swollen-up barrier sets on a flat surface such as the surface of an automobile driveway, to block water flow; or when the barrier is laid against a vertical surface such as a wall or doorway; or when the barrier mates with other barriers when stacked, as sand bags are commonly stacked.

"Open area" is that portion of the surface area of sheath material which allows the passage of water. Alternately stated, it is the area of the holes in the sheath. "Percent open area" is the unit open area of the holes as a fraction of a unit total area of sheath. Sheaths of the present invention will range from about 25 percent to about 60 percent open area; more preferably between about 36 percent and about 48 percent open area. Of course, sleeve material will be visible to a viewer anywhere there are openings in the sheath. So, the fraction of a barrier external surface which is presented to a viewer as being sleeve material is the same as the fraction of the sheath which is open area.

When the sheath has the foregoing broader range of opening areas, simple calculation leads to there being between about 40 and about 75 percent of a unit area of barrier external surface presented as structural fabric which comprises the sheath. That range will be between about 24 and about 52 percent when the sheath has foregoing narrower range of openings stated in the preceding paragraph.

When the external surface sheath material fraction is less than the foregoing lower limits, the protection provided by the sheath to the sleeve (from abrasion) and any perceived change in color/visibility (due to the sheath being a bright/visible color) will both be lessened. When the sheath material external surface fraction is above the foregoing upper limits, the flow of water to the sleeve through the sheath can be lessened. In particular, the capacity of a swelled up barrier to be dried may be impeded.

Nonwoven permeable polymeric fabrics useful in the present invention are often referred to as geotextiles, in particular when they are used in connection with soil engineering. Such fabrics are comprised of interwoven and adhered together small resilient fibers which may have been needle punched. Nonwoven fabrics do not have defined openings or a repeating pattern, comparable to the openings of meshes mentioned here. Nonwoven polymeric fabrics which are used to form the sleeve of a barrier may be compared to each other by measuring their capacity to flow water, expressed as permittivity.

Thus, insofar as applicant knows, non-woven fabrics are not easily characterizable with respect to percent open area, as are meshes. However, a geotextile may be characterized as having an Apparent Opening Size (AOS). AOS indicates the diameter of the approximate largest particle that passes through a particular geotextile. For example, a Dupont spun bonded nonwoven fabric SF20 has an AOS of 0.595 mm and fabric SF65 has an AOS of 0.09 mm. Although it is somewhat conceptually imperfect to compare an AOS (which relates to passage of a solid) to a mesh opening (which in the present context relates to passage of a liquid), it would nonetheless appear that, with respect to gelatinous material, a sheath material (mesh) of the present invention has openings each of which is several times larger, i.e., 6 to up to maybe 40 times larger, in size than the openings that characterize a non-woven fabric of a sleeve. It hardly needs to be stated, but the holes of exemplary meshes would not contain the gelatinous mass of absorbent.

Returning again to discussion of the fraction open area of sheaths: To summarize some of what is said above, the function of the nonwoven sleeve is to allow water to pass into the sleeve concavity, and to prevent escape of the gelatinous water-saturated absorbent. The function of the sheath, while surrounding the sleeve, is to let water pass through the sheath to contact the exterior of the sleeve (and to let water escape from the sleeve when a barrier is being dried), while encompassing and physically protecting the sleeve and enabling improved visibility.

Since, as mentioned elsewhere, it is desirable to have a dark color sleeve, visibility is enhanced if the sheath of an encased barrier is made of a bright visible color. However, the effective visibility of an encased barrier is diminished if the percent open area is significantly greater than the maximum(s) stated above. That is because, particularly at a distance, to the eye the bright color of a sheath can be diminished by seeing it merged with the darker color of a sleeve material which is visible through the mesh openings of the sheath. That leads one to want a small open area.

Further, if the percent open area is greater than the maximums recited above (and assuming large open area correlates with larger individual openings), local portions of the sleeve may, due to swelling of the absorbent, protrude through openings of the sheath. Where the sleeve protrudes (or where stones and the like can intrude), the sleeve can be more vulnerable than otherwise to damage. That leads one to want small open area. The sheath also will add strength to the article as a whole, offering the possibility of using a thinner sleeve fabric should such be desired.

On the other hand, when the percent open area is small, while visibility of a bright sheath and resistance to abrasion damage may be better, the passage of water through the sheath, to the sleeve, can be impeded. That can perhaps be more significant for those users which seek to dry out the absorbent after a use.

An exemplary sheath, for example, one made of aforesaid Apex Mills fabric is made of woven material that provides the desired resistance to abrasion. The woven fabric is in differentiation to a mesh sheath made of a plastic film which has punched openings. The preferred Apex Mills invention fabrics present as a somewhat coarse woven materials having spaces between the woven fibers that define the fabric. Those spaces can allow flow of water or water vapor through the fabric structure itself. That is, an exemplary sheath is water permeable irrespective of openings in the sheath material. That adds somewhat to the ability for water and water vapor to move between the absorbent and the atmosphere external to the encased barrier.

To summarize some of what is said above, the function of the nonwoven sleeve is to allow water to pass through the sleeve, into the sleeve concavity, while preventing escape of the gelatinous water-saturated absorbent. The function of the sheath is to let water pass through to contact the exterior of the sleeve (and to escape from the sleeve when the barrier is being dried) while physically protecting the sleeve and enabling improved visibility.

While the invention has been described in terms of tubular barriers, in the generality of the invention, encased barriers may have other shapes, including rectanguloid and semi-spherical, etc. For such products, the non-woven fabric structure holding the water absorbent material shall be considered equivalent to a sleeve as described herein. While the invention has been characterized in terms of use of polymeric materials, fabrics made of natural fibers may be substituted.

The invention, with explicit and implicit variations and advantages, has been described and illustrated with respect to several embodiments. Those embodiments should be considered illustrative and not restrictive. Any use of words such as "preferred" and variations suggest a feature or combination which is desirable but which is not necessarily mandatory. Thus, embodiments lacking any such preferred feature or combination may be within the scope of the claims which follow. Persons skilled in the art may make various changes in form and detail of the invention embodiments which are described, without departing from the spirit and scope of the claimed invention.

What is claimed is:

1. A barrier, for use in in blocking the flow of surface waters when laid on a surface, having a length, opposing lengthwise ends, a width, and a front end and an opposing rear end, comprising:

a first tubular element, made of needle punched nonwoven polymer fabric, having a first plurality of openings for passage of water, the first tubular element containing a quantity of substance that upon contact with water expands in volume and forms a gelatinous mass, wherein each first plurality of openings is small enough to inhibit any substantial passage of said gelatinous mass; and, a second tubular element, surrounding the first tubular element, comprising mesh fabric, having a second plurality of openings for passage of water, said second plurality of openings each having a size that is greater than each of the first plurality of openings and larger than can inhibit substantial passage of said gelatinous mass;

wherein the second tubular element overlies the first tubular element; and wherein the second tubular element is made of woven polymer fiber fabric that is water permeable irrespective of said second plurality of openings.

2. The barrier of claim 1 wherein the second tubular element has an open area fraction that is between 25 percent and 60 percent.

3. The barrier of claim 1 wherein the second tubular element has an open area fraction that is between 36 percent and 48 percent.

4. The barrier of claim 1 wherein a multiplicity of openings of said second plurality of openings are each approximately equivalent in size to a round hole having a diameter of 4 to 5 millimeters and are 6 to 40 times larger than the average opening size of the first plurality of openings.

5. The barrier of claim 1 wherein said quantity of substance that absorbs water upon contact is super-absorbent polymer in powder or sheet form.

6. The barrier of claim 1 wherein, at each lengthwise end, the second tubular element and the first tubular element are attached to each other by stitching or other fasteners which are positioned along a line running transverse to the length of the barrier.

7. A method of blocking the flow of water across a surface which comprises:

providing a barrier of claim 1 in dry and substantially flat condition;

contacting the barrier with water sufficient to cause water to flow through the second plurality of openings of said second tubular element, to contact the first tubular element and flow through the first plurality of openings, thereby to contact said quantity of substance and to cause the quantity of substance to swell up;

wherein the barrier is positioned on said surface and in contact therewith.

8. The method of claim 7 further comprising: removing the barrier from contact with said water and allowing the barrier to dry by passage of water or water vapor through the first plurality of openings and through the second plurality of openings.

9. A barrier, for use in in blocking the flow of surface waters when laid on a surface, having a length, opposing lengthwise ends, a width, and a front end and an opposing rear end, comprising:

a first tubular element, made of nonwoven polymer fabric, having a first plurality of openings for passage of water, the first tubular element containing a quantity of substance that upon contact with water expands in volume and forms a gelatinous mass, wherein each first-plurality of openings is small enough to inhibit any substantial passage of said gelatinous mass; and, a second tubular element, surrounding the first tubular element, comprising mesh fabric having a second plurality of openings for passage of water, said second plurality of openings each having a size that is greater than each of the first plurality of openings and larger than can inhibit substantial passage of said gelatinous mass;

wherein the second tubular element has an open area fraction that is between 36 percent and 48 percent;

wherein a multiplicity of openings of said second plurality of openings are each approximately equivalent in size to a round hole having a diameter of 4 to 5 millimeters and are between 6 and 40 times larger than the average size of the openings of said first plurality of opening; and, wherein the first tubular element is black or brown in color and the second tubular element is orange, yellow or other color that is a different and lighter color than said black or brown color.

10. The barrier of claim 9 wherein the second tubular element has an open area fraction that is between 25 percent and 60 percent.

11. The barrier of claim 9 wherein the second tubular element has an open area fraction that is between 36 percent and 48 percent.

12. The barrier of claim 9 wherein said quantity of substance that absorbs water upon contact is super-absorbent polymer in powder or sheet form.

13. The barrier of claim 9 wherein, at each lengthwise end, the second tubular element and first tubular element are attached to each other by stitching or other fasteners which are positioned along a line running transverse to the length of the barrier.

* * * * *